US005771729A

United States Patent [19]

Bailey et al.

[11] Patent Number: 5,771,729

[45] Date of Patent: Jun. 30, 1998

[54] PRECISION DEEP PEENING WITH MECHANICAL INDICATOR

[75] Inventors: Peter G. Bailey, Hamilton; Dewey D. Dunkman, Cincinnati, both of Ohio

[73] Assignee: General Electric Company, Cincinnati, Ohio

[21] Appl. No.: 886,167

[22] Filed: Jun. 30, 1997

[51] Int. Cl.[6] ..... B21J 9/20

[52] U.S. Cl. ..... 72/53; 29/90.7

[58] Field of Search ..... 29/90.7; 72/53

[56] References Cited

U.S. PATENT DOCUMENTS

| | | | |
|---|---|---|---|
| 1,483,328 | 2/1924 | Booker . | |
| 1,784,866 | 12/1930 | Fahrenwald . | |
| 1,953,842 | 4/1934 | Wearne | 153/26 |
| 3,937,055 | 2/1976 | Caruso et al. | 72/53 |
| 4,226,111 | 10/1980 | Wahli | 72/437 |
| 4,416,130 | 11/1983 | Judge, Jr. | 72/10 |
| 4,641,510 | 2/1987 | Mitsching et al. | 72/53 |
| 4,848,123 | 7/1989 | Thompson | 72/53 |
| 4,974,434 | 12/1990 | Reccius et al. | 72/53 |
| 5,591,009 | 1/1997 | Mannava et al. | 416/241 R |

*Primary Examiner*—David Jones

*Attorney, Agent, or Firm*—Andrew C. Hess; Nathan D. Herkamp

[57] ABSTRACT

An apparatus produces compressive stress in a component surface. Positioning of a contact area of the component surface is controlled to situate a contact area of the component surface relative to an indenter element. The indenter element is fixtured to cause an indentation at the contact area. The force of the indentation is measured as the indenter element contacts the contact area, and controlled responsive to the amount of force measured and the desired compression. The system allows deep compressive stresses to be generated without the surface damage associated with conventional peening.

15 Claims, 1 Drawing Sheet

PRECISION DEEP PEENING WITH MECHANICAL INDICATOR

TECHNICAL FIELD

The present invention relates particularly to peening of local areas on fan and compressor airfoils and rotating parts that require unusually deep surface compressive stresses.

BACKGROUND OF THE INVENTION

Shot peening is a compressive stress producing process that is routinely applied to rotating parts, fan/compressor airfoils and high stress static parts to negate machining tensile stresses, protect against surface inclusions, reduce fretting and prevent stress corrosion cracking. In general, relatively shallow compressive depths (up to 0.010") are sufficient for these purposes. Conventional peening much beyond this depth can cause surface damage that reduces part life. Greater than conventional compressive depth can be accompanied by increased damage because the increased shot velocity required produces deeper dimples with increased cold work and leads to the loss of surface ductility. It also leads to creation of crack initiating laps and folds. Larger shot can be used to reduce damage via shallower dimples but is often considered uneconomic because of increased peening time. Doubling shot size increases peening times eight times since each dimple requires a shot strike and doubling size reduces the number of particles per pound of shot by a factor of eight.

Another method employing large shot (up to 1/10" diameter) is gravity accelerated shot peening (GASP). However, GASP is used mainly to achieve smooth surface finishes, such as in large airfoils, rather than deep compressive layers. Laser shock peening (LSP) is currently being developed to produce very deep compressive layers (approximately 0.030") and does so with minimal surface damage because of an extremely large "dimple" size. Unfortunately, LSP is expensive, has high maintenance equipment and low production rates. LSP development has shown that the pattern of the "dimples" is extremely important in producing the desired crack arresting effect.

It would be desirable, then, to be able to provide the "large dimple" effect of LSP without the high cost, high maintenance, and low production drawbacks of existing shot peening methods.

SUMMARY OF THE INVENTION

The present invention provides for precision deep peening of local areas on workpieces that require unusually deep surface compressive stresses to prevent propagation of cracks occurring either from foreign object damage or unexpectedly high service stresses. The present invention produces the "large dimple" LSP effect mechanically by pressing the part surface with large peening elements, such as balls, in a predetermined pattern. The present invention also allows for opposing surfaces, such as airfoil edges, to be pressed simultaneously to minimize distortion.

In accordance with one aspect of the present invention, a process for producing compressive stress in a component surface comprises a pair of peening elements on opposing ends of a fixture; a load cell in line with the pair of peening elements measures the force of the compression; positioning means align the component between the pair of opposing peening elements; and a lever causes a first one of the pair of peening elements to move toward the second one of the pair of peening elements, to squeeze opposite sides of an airfoil. An X-Y positioning table is moved in predetermined steps to produce a precisely patterned placement of dimples in the component surface.

In the drawings as hereinafter described, a preferred embodiment is depicted; however, various other modifications and alternative constructions can be made thereto without departing from the true spirit and scope of the invention.

BRIEF DESCRIPTION OF THE DRAWING

The novel features of the invention are set forth with particularity in the appended claims. The invention itself, however, both as to organization and method of operation, together with objects and advantages thereof, may best be understood by reference to the following description taken in conjunction with the accompanying drawing in which:

DETAILED DESCRIPTION OF THE INVENTION

Figure 1:
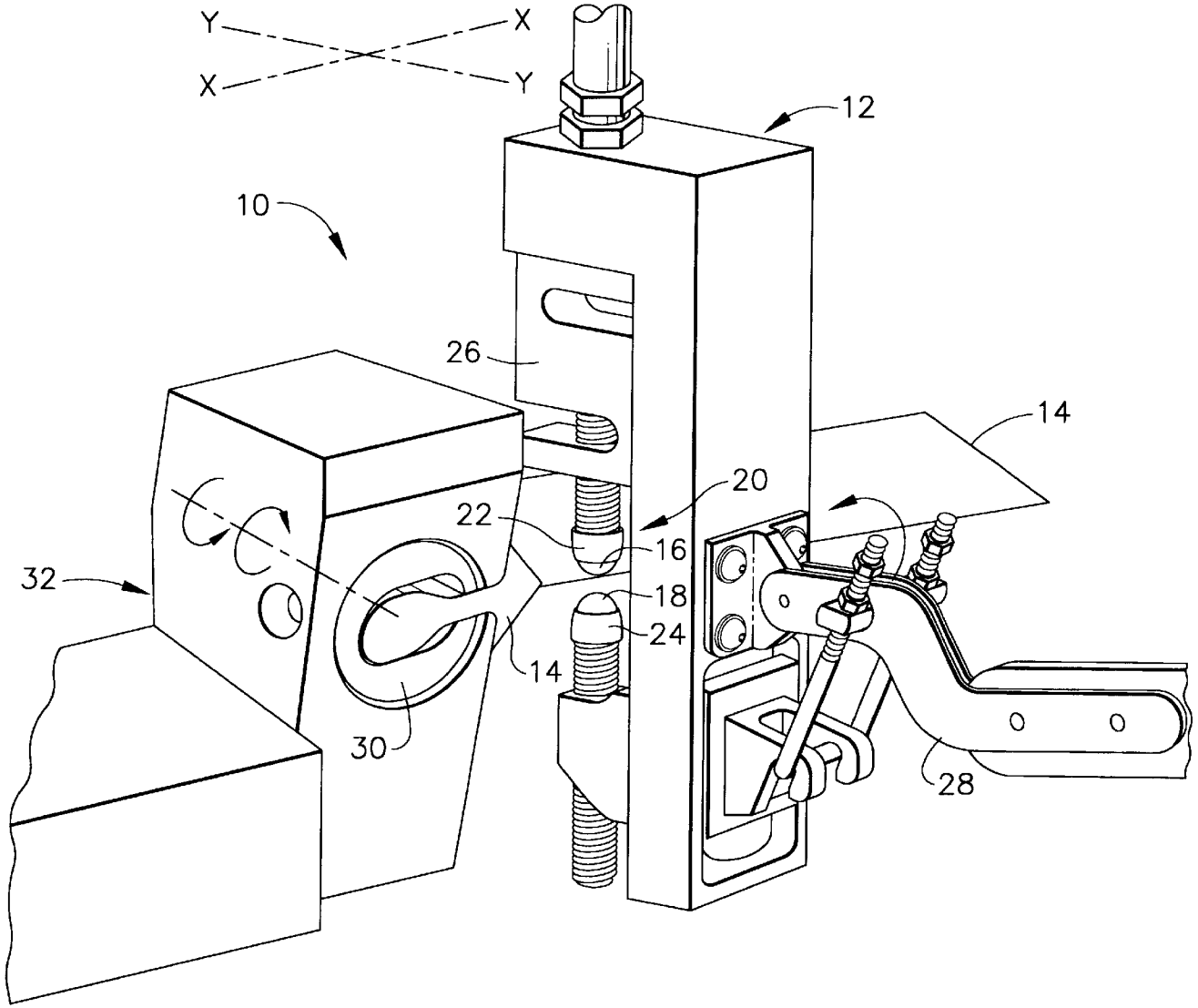
FIG. 1 is an isometric view of the precision deep peening assembly in accordance with the present invention.

The present invention will be described with respect to peening of local areas on fan and compressor airfoils and rotating parts; those skilled in the art, however, will recognize that the principles of the present invention could be easily adapted or modified for use on a variety of components.

Referring initially to FIG. 1, there is illustrated a precision deep peening assembly 10 with a mechanical indenter means 12 for dimpling or peening local areas on, for example, fan and compressor airfoils 14. The mechanical indenter means comprises first and second indenter elements or peening elements 16 and 18. In a preferred embodiment of the present invention, the peening elements 16 and 18 comprise ball bearings, associated with anvils 22 and 24, respectively, fixtured to cause an indentation at the contact area on the component 14. As will be obvious to those skilled in the art, the indenter elements may be any suitable means, including rollers or varying and multiple shapes, arranged in predetermined patterns to provide directional stress patterns.

Continuing with FIG. 1, load cell 26 is provided in line with the peening elements to measure squeeze force and allow control of dimple size and depth uniformity. A lever 28 operates one of the ball anvils to provide a press motion. The lever causes a first one of the pair of peening elements to move toward the second one of the pair of peening elements, to squeeze opposite sides of the component 14.

The airfoil or other part to be processed is mounted in flexible holder 30 associated with a carrier mounting block 32 to allow rotation of the part. The part is rotated so that the immediate surface to be dimpled is inserted perpendicularly between peening elements 16 and 18 of clamp means 20. This is attached to an X-Y oriented table to provide precise positioning of the press point. Dimensional X-Y locations may be controlled by any suitable means, such as by an operator reading a position gage and manually positioning the part, or by a numerically controlled programmed positioning system. The rotation allows curved airfoil surfaces to maintain perpendicularity at point of contact. The part is then squeezed, rather than impacted, using lever means 28, to produce the desired dimpling effect. This method of peening allows for precise patterned placement of dimples rather than random strikes.

Control of the squeezing process is an important feature of the present invention. The amount of force needed to achieve the desired peening effect is determined experimentally by correlating a desired dimple size with a desired compressive stress depth. The force may be measured by a load cell inserted between the indenter balls 16, 18 and the force generating mechanism, i.e., lever 28. Control of the force may be manual, by an operator watching, for example, a dial, and operating a lever responsive thereto, or by closed loop numerical control.

In a preferred embodiment of the present invention, the peening elements 16 and 18 are larger than conventional balls. However, the peening assembly 10 of present invention is capable of providing the deep compressive layer in a surface of the part, while utilizing the low surface damage for advantages of larger balls, without the inherent drawbacks of using larger balls in conventional peening. Conventional peening with balls this size would be impractical, if not impossible.

Although the invention has been described with reference to ½" ball indenters, then, it will be obvious to those skilled in the art that alternative forms of peening elements may also be used without departing from the scope of the invention. For example, multiple ball segments may be attached to a platen to produce multiple dimples with each press motion. Furthermore, opposing surfaces of the part, for example airfoil edges, can be pressed simultaneously to minimize distortion. Of course, on thicker sections such as on rotating turbine or compressor disks, there may be no need to simultaneously peen both sides of the part. In such cases, the process may be carried out on a press with a single ball or shaped pattern. Various overlap patterns and indenter frontal shapes can further improve the life of the part, over a conventionally peened part, whether applied to one or multiple surfaces of a part. For example, multiple ball segments attached to a platen can produce multiple dimples with each press motion, and segments of other shapes such as oval, elliptical, or racetrack can provide directional stress patterns. Patterns may also be made by moving rolls with parallel or crisscross motions rather than stationary shapes.

The present invention provides a process for producing deep compressive stress and residual stress in component surfaces without risk of fatigue degrading surface damage that would accompany high intensity conventional shot peening. The deep compressive stress is created by indenting the surface with a ball or other contoured indenter, or a flat indenter with contoured edges, with a controlled overlap pattern. The controlled overlap pattern can be achieved by any of a variety of suitable means, such as a die with multiple indenter faces arranged in a specific pattern, numerical control positioning of a single or patterned indenter, or a contoured roller operated in a parallel or crossing pattern. The deep compressive stress can be generated on opposite surfaces of a component by simultaneous indenting from both sides.

While preferred embodiments of the present invention have been shown and described herein, it will be obvious to those skilled in the art that such embodiments are provided by way of example only. Numerous variations, changes, and substitutions will now occur to those skilled in the art without departing from the invention and those skilled in the art will recognize that the principles of the present invention could be easily adapted or modified to achieve peening of any component, particularly parts that require unusually deep surface compressive stresses to prevent propagation of cracks occurring either from foreign object damage or unexpectedly high service stresses. Accordingly, it is intended that the invention be limited only by the spirit and scope of the appended claims.

What is claimed is:

1. An apparatus for producing compressive stress in a component surface comprising:

positioning means to control positioning of a contact area of the component surface;

at least one indenter element fixtured to contact the component surface and cause an indentation at the contact area;

measurement means to measure force of the at least one indenter element as the at least one indenter element contacts the contact area; and control means to control force of the at least one indenter element at the contact area.

2. An apparatus as claimed in claim 1 wherein the positioning means comprises an X-Y table.

3. An apparatus as claimed in claim 1 wherein the at least one indenter element comprises first and second indenter elements.

4. An apparatus as claimed in claim 3 wherein the first and second indenter elements are located to contact opposing sides of the component surface.

5. An apparatus as claimed in claim 4 wherein the first and second indenter elements simultaneously peen the opposing sides of the component surface.

6. An apparatus as claimed in claim 1 wherein the at least one indenter element comprises a ball shaped indenter element.

7. An apparatus as claimed in claim 1 wherein the at least one indenter element comprises a roller.

8. An apparatus as claimed in claim 1 wherein the at least one indenter element comprises multiple shapes arranged in a predetermined pattern.

9. An apparatus as claimed in claim 1 wherein the measurement means comprises a load cell.

10. An apparatus as claimed in claim 1 wherein the control means comprises a lever.

11. An apparatus as claimed in claim 1 wherein the indentation is achieved by a pressing action.

12. A method for producing deep compressive stresses in a component surface comprising the steps of:

controlling positioning of a contact area of the component surface;

fixturing at least one indenter element to contact the component surface;

using pressing force to cause the at least one indenter element to make an indentation at the contact area; and measuring the pressing force as the at least one indenter element contacts the contact area.

13. A method as claimed in claim 12 further comprising the step of controlling the pressing force of the at least one indenter element at the contact area.

14. A method as claimed in claim 12 wherein the at least one indenter element comprises an indenter having a curved surface.

15. A method as claimed in claim 12 wherein the at least one indenter element comprises a roller.

* * * * *

UNITED STATES PATENT AND TRADEMARK OFFICE

CERTIFICATE OF CORRECTION

PATENT NO. : 5,771,729

DATED : June 30, 1998

INVENTOR(S) : Peter G. Bailey et al.

It is certified that error appears in the above-identified patent and that said Letters Patent is hereby corrected as shown below:

On the title page, item [54] and column 1, line 2, change "INDICATOR" to --INDENTER--.

Signed and Sealed this

Twenty-ninth Day of September, 1998

*Attest:*

*Attesting Officer*

BRUCE LEHMAN

*Commissioner of Patents and Trademarks*